United States Patent [19]

Take et al.

[11] 4,364,040

[45] Dec. 14, 1982

[54] ELECTROCHROMIC DISPLAY DRIVER WITH FACULTIES OF STABILIZING COLORATION CONTRAST AND INSURING UNIFORM BLEACHING CONDITION

[75] Inventors: Hiroshi Take; Katubumi Koyanagi, both of Tenri; Hisashi Uede, Yamatokoriyama, all of Japan

[73] Assignee: Sharp Kabushiki Kaisha, Osaka, Japan

[21] Appl. No.: 94,568

[22] Filed: Nov. 15, 1979

[30] Foreign Application Priority Data

Nov. 16, 1978 [JP] Japan ..... 53-141983

[51] Int. Cl.[3] ..... G09G 3/34

[52] U.S. Cl. ..... 340/785; 350/357; 340/763

[58] Field of Search ..... 340/785, 763; 350/357

[56] References Cited

U.S. PATENT DOCUMENTS 3,987,433 10/1976 Kennedy ..... 340/785
4,201,984 5/1980 Inami et al. ..... 350/357
4,201,985 5/1980 Inami et al. ..... 350/357
4,209,770 6/1980 Hamada et al. ..... 350/357
4,210,907 7/1980 Hamada et al. ..... 350/357

OTHER PUBLICATIONS

*Electrochromic Display Devices,* Bruinink, Proc. of 4th Brown-Boveri Symposium on Nonemissive Electro-optic Displays, 9/75, pp. 201-218.

*Primary Examiner*—Marshall M. Curtis
*Attorney, Agent, or Firm*—Birch, Stewart, Kolasch & Birch

[57] ABSTRACT

A driving circuit is provided for coloring and erasing a plurality of segment electrodes contained within an electrochromic display. The driving circuit comprises a first circuit for applying a constant current to at least one of the segment electrodes for coloring purposes, a second circuit for short circuiting the colored ones of the segment electrodes, and a third circuit for applying a constant voltage to at least one of the colored segment electrodes for erasing purposes. A plurality of pulses respectively resulting from the constant current and the constant voltage are applied to the selected segment electrodes on timesharing basis. The second circuit comprises a circuit element belonging to a part of the first circuit or a third circuit.

11 Claims, 11 Drawing Figures

ELECTROCHROMIC DISPLAY DRIVER WITH FACULTIES OF STABILIZING COLORATION CONTRAST AND INSURING UNIFORM BLEACHING CONDITION

BACKGROUND OF THE INVENTION

The present invention relates in general to an electrochromic display and, more particularly, to a driving circuit for an electrochromic display having a plurality of segment electrodes to be colored, the driving circuit being provided for uniformizing the depth of coloration and for insuring a uniform bleaching condition of the segment electrodes.

It is preferable that an electrochromic display be driven by the constant current driving method in a coloring mode and by the constant voltage driving method in an erasing mode, as disclosed in a copending Patent Application Ser. No. 915,003 filed June 13, 1978, assigned to the present assignee, for example.

The above stated driving method disclosed in Patent Application Ser. No. 915,003 had disadvantages that if and when a driving circuit was incorporated into a semiconductor chip, variations in the electrical properties of driving elements such as transistors formed within the semiconductor chip led to non-uniformity of coloration degree or depth among a plurality of segment electrodes included within an electrochromic display. The variations come from changes of conditions in manufacturing the driving elements.

In order to overcome these and other problems there are proposed in assignee's U.S. Patent Application Ser. No. 056,629 by H. Fukuda et al, filed July 11, 1979, an improved driving circuit for coloring all the segment electrodes included within an electrochromic display in a uniform coloration.

However, there were unsolvable problems in the driving circuit as disclosed in U.S. Patent Application Ser. No. 056,629 in that an appreciable degree in non-uniformity of coloration depth among the segment electrodes existed because of reasons present both in the driving circuit integrated and in cell structure of the electrochromic display cell.

The reasons for the above were that it was difficult to accurately control the modification of the size of the transistors enough to allow for the variations in the size of the segment electrodes because of the difficulty in controlling the process therefor. The variations in electronic properties of the transistors led directly to that of the constant current value.

The same was true of the fact that the size of the segment electrodes deviated from intended calculation values because of variations in their manufacturing conditions, for example, etching procedures. Especially, the variations in the size of some small segment electrodes became increasingly critical.

Therefore, it is desired that the change in coloration depth in all of the segment electrodes be completely eliminated with respect to the constant current driving circuit in the coloring mode and the constant voltage driving circuit in the erasing mode.

SUMMARY OF THE INVENTION

With the foregoing in mind, it is a main object of the present invention to provide an improved driving circuit for an electrochromic display for a constant current driving circuit in a coloring mode and for a constant voltage driving circuit in an erasing mode.

It is a further object of the present invention to provide an improved driving circuit for an electrochromic display, the driving circuit comprising at least one switching element for uniformizing the coloration depth in a plurality of segment electrodes, the switching element being operated to cause a coloring mode or an erasing mode.

It is a further object of the present invention to provide an improved driving circuit for an electrochromic display, the driving circuit containing a switching element for short circuiting the segment electrodes to be colored to each other in order to eliminate variations in coloration depth in the segment electrodes, the switching element being operated to cause a coloring mode or an erasing mode.

It is another object of the present invention to provide an improved driving circuit for an electrochromic display, the driving circuit comprising a means for applying erasing pulse signals to some segment electrodes to be erased in a time-sharing manner in order to completely erase the segment electrodes.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a driving circuit is provided for coloring and erasing a plurality of segment electrodes contained within an electrochromic display. The driving circuit comprises a first circuit for applying a constant current to at least one of the segment electrodes for coloring purposes, a second circuit for short circuiting the colored ones of the segment electrodes, and a third circuit for applying a constant voltage to at least one of the colored segment electrodes for erasing purposes.

A plurality of pulses respectively resulting from the constant current and the constant voltage are applied to the selected segment electrodes on a timesharing basis. The second circuit comprises a circuit element belonging to a part of the first circuit or a third circuit.

BRIEF DESCRIPTION OF THE DRAWINGS

The present invention will become more fully understood from the detailed description given hereinbelow and accompanying drawings which are given by way of illustration only, and thus are not limitative of the present invention and wherein;

FIG. 6(A) is a time chart of the control signals generated from the signal generator indicated in FIG. 6;

DESCRIPTION OF THE INVENTION

Figure 1:
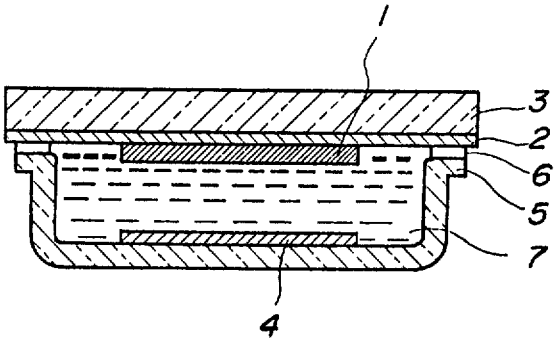
FIG. 1 is a cross-sectional view of a conventional electrochromic display cell.

Referring to FIG. 1, the conventional electrochromic display cell shown in FIG. 1 comprises an electrochromic film 1 made of $WO_3$or so, an $In_2O_3$ film 2, a glass substrate 3, a counter electrode 4, a dish-shaped glass substrate 5, a seal member 6, and an electrolyte 7.

The electrochromic film 1 and the $In_2O_3$ film 2 form a display electrode arranged on the glass substrate 3. The counter electrode 4 is formed on the dish-shaped glass substrate 5. The glass substrate 3 and the dish-shaped glass substrate 5 are adhered to each other at their edges by the seal member 6. The electrolyte 7 is disposed within a compartment defined by the two glass substrates 3 and 5. A pigment element of, for example a white color can be dispersed within the electrolyte 7 to provide a background for the electrochromic film 1 which is colored with the help of the well-known electrochromic phenomena.

Figure 2:
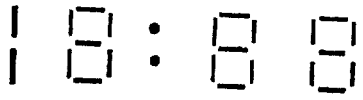
FIG. 2 is a plan view of a symbol defined by a plurality of segment electrodes formed in the conventional electrochromic display cell shown in FIG. 1.

FIG. 2 shows a plan view of an exemplary symbol defined by a plurality of segmented electrodes comprising the electrochromic film 1. A driving circuit of the present invention can be applied to any other types of the segmented electrodes representing other specific symbols.

Figure 3:
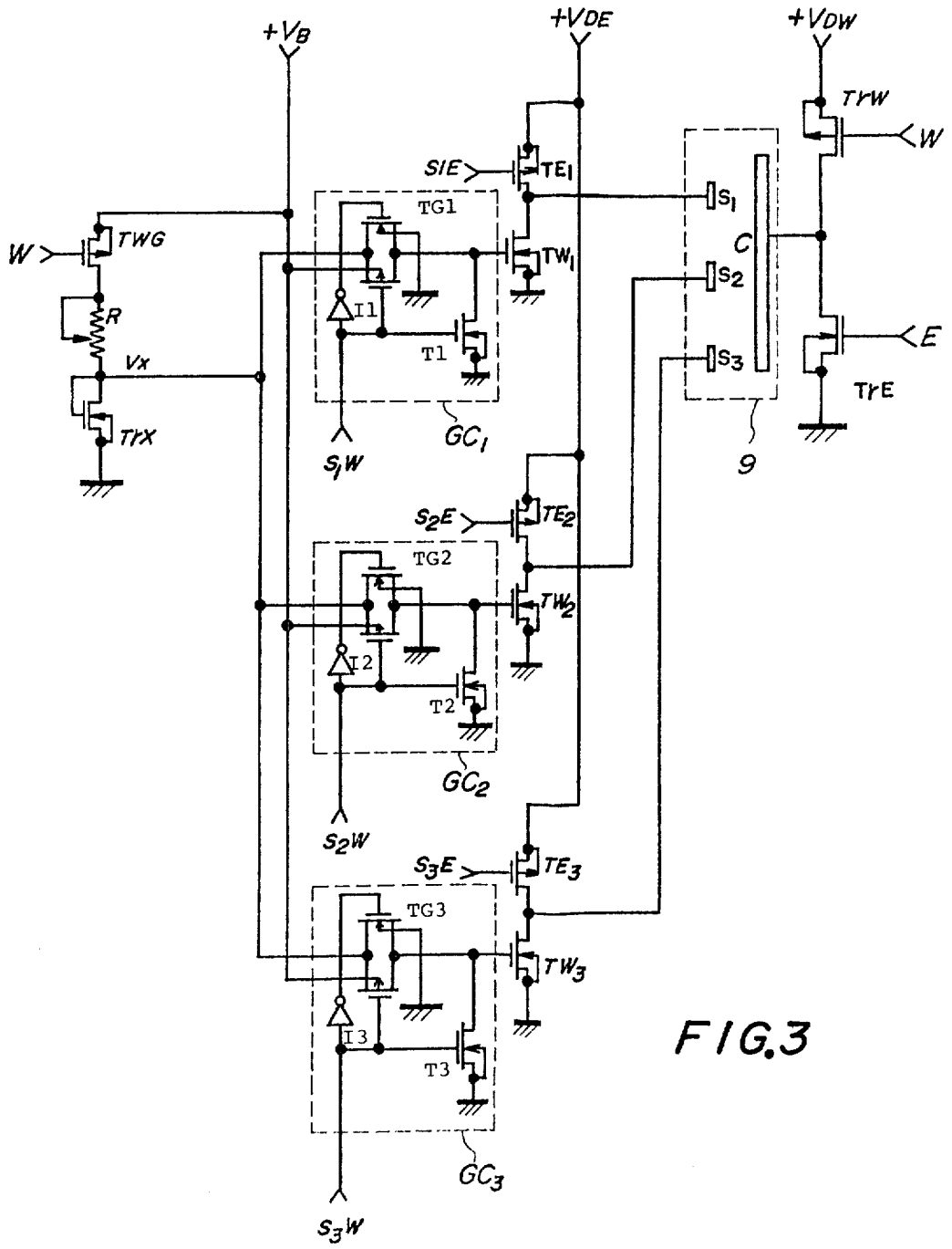
FIG. 3 is a circuit configuration of a specific driving circuit according to the present invention for the conventional electrochromic display cell depicted in FIG. 1.

FIG. 3 shows a driving circuit of the present invention, incorporated into a semiconductor chip, acting as a constant current driving circuit in a coloring mode and a constant voltage driving circuit in an erasing mode. For convenience of explanation only, there are provided three segment electrodes to be colored. However, the number of the segment electrodes can be readily altered.

With reference to FIG. 3, an electrochromic display cell is denoted as numeral 9 containing three segment electrodes $S_1$ to $S_3$, and the counter electrode C. There are connected a plurality of transistor, in particular, MOS transistors TrW, TrE, TE1 to TE 3, TW1 to TW3, TrX and TWG. A first group of transistors TrW, TW1 to TW3 is activated to cause the coloring mode where at least one selected from the segment electrodes S1 to S3 is colored.

A second group of transistors TrE, TE1 to TE3 is activated to cause the erasing mode where at least one of the colored segment electrodes S1 to S3 is completely erased.

There are further provided three gate control circuits GC1 to GC3 each containing a transmission gate TGi, a transistor Ti, in particular MOS transistor, and an inverter Ii. There are applied to the driving circuit of FIG. 3 a plurality of control signals S1W, S1E, S2E, S3W, S3E, W and E for controlling the operation of the driving circuit. A resistor R is connected between the MOS transistors TWG and TrX.

In operation,, the MOS transistor TrW is connected to the counter electrode C, the MOS transistor TrW being operated to conduct a writing voltage VDW from a power supply source to the counter electrode C when writing timing signals W are applied to the gate of the MOS transistor TrW. The writing timing signals W also enter the gate of the MOS transistor, TWG so that the MOS transistor TWG becomes conductive. In consequence, a power voltage VB is applied to the registor R so that a constant voltage VX is developed at a line connected to the gate and the source of the MOS transistor TrX. The constant voltage VX is applied to the gate control circuits GG1 to GC3 and then to the three MOS transistors TW1 to TW3 only when the coloring mode should be caused.

The three MOS transistors TW1 to TW3 are respectively connected to the three segment electrodes S1 to S3. The three MOS transistors TW1 to TW3 are all operated to develop a constant amount of current.

That is, the writing timing signals W act as gate controlling signals for the MOS transistor TWG. The MOS transistors TrW and TWG are turned conductive if the writing timing signals W are at a low level.

The MOS transistor TrE is also connected to the counter electrode C. Erasure timing signals E are introduced to the gate of the MOS transistor TrE only when the erasing mode should be carried out by use of the driving circuit. The MOS transistor TrE becomes conductive in response to the erasure timing signals E in a high level.

Three sets of write controlling signals S1W to S3W are applied to the relevant gate control circuits GC1 to GC3 so that the constant voltage VX is selectively entered to the gates of the MOS transistors TW1 to TW3. The constant voltage VX is introduced into the gate of the MOS transistors TW1 to TW3 selected under the condition where the relevant writing controlling signals S1W to S3W are at low level.

In response to the application of the writing controlling signals S1W to S3W at a low level, the gate control circuits GC1 to GC3 are operated so that the constant voltage VX is applied to the gate of the MOS transistors TW1 to TW3 at a high level. The relevant MOS transistor T1 to T3 is rendered conductive to thereby ground the gate of the MOS transistors TW1 to TW3. The MOS transistors TW1 to TW3 are not conductive.

The MOS transistors TE1 to TE3 specified as the second group are operated to provide a constant voltage for causing the erasing mode. Three sets of erasure controlling signals S1E to S3E are respectively entered to the gate of the MOS transistors TE1 to TE3 each connected to the segment electrodes S1 to S3. When at least one of the erasure controlling signals S1E to S3E is at a low level, the related one of the MOS transistors TE1 to TE3 is conductive so that an erasing voltage VDE is then entered to the related one of the segment electrodes S1 to S3 for erasing purposes.

Figure 4:
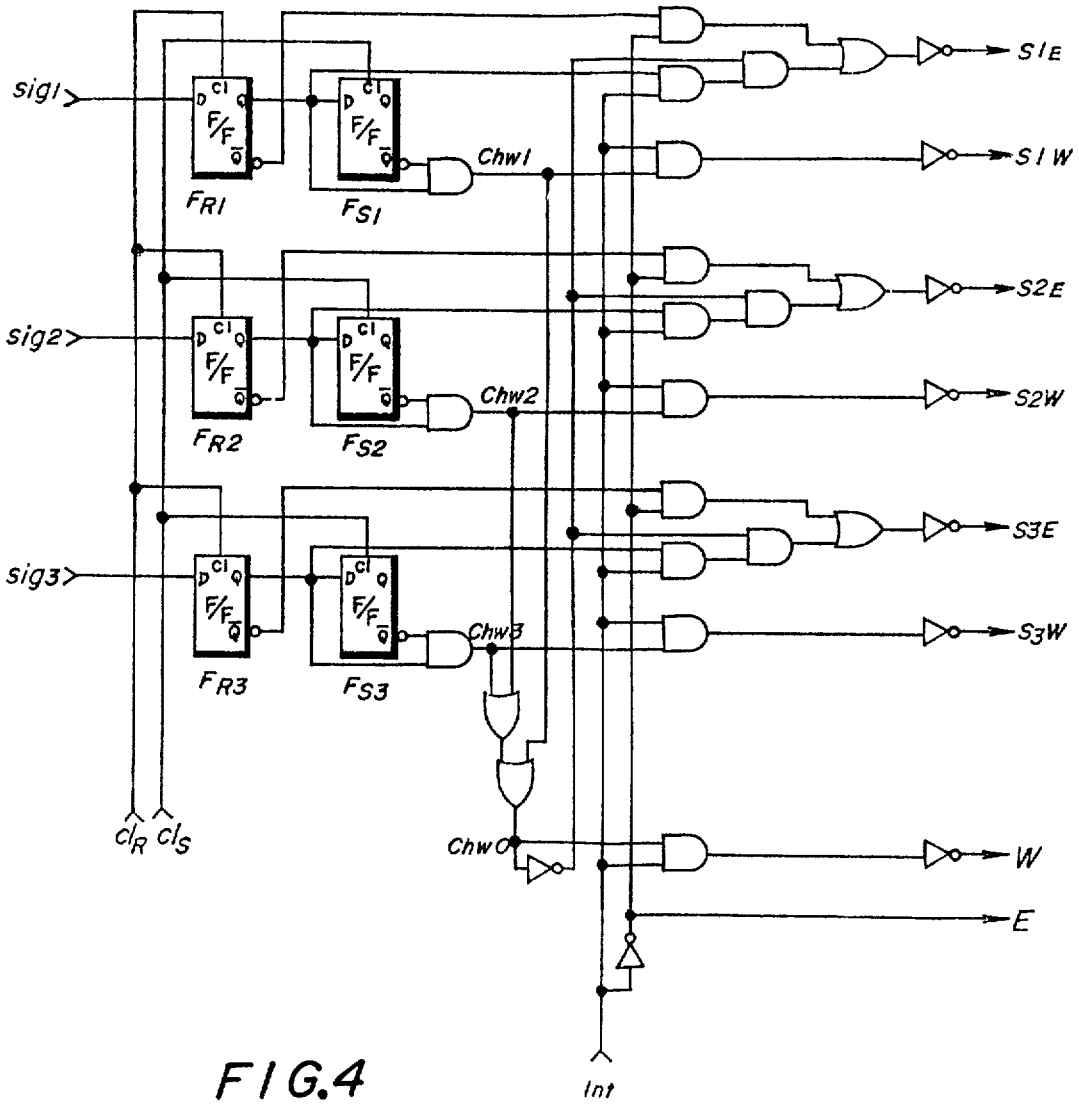
FIG. 4 is a circuit configuration of a specific signal generator for developing a plurality of signals used to control the driving circuit illustrated in FIG. 3.

FIG. 4 shows a signal generator for developing a plurality of kinds of signals used to control the driving circuit illustrated in FIG. 3. Referring to FIG. 4, there are provided a plurality of flip-flop circuits FR1 to FR3 and FS1 to FS3. A plurality of logic circuits, e.g., AND gates, OR gates, and inverters are connected to these flip-flop circuits. There are applied a plurality of input signals SiG1 to Sig3, clock signals ClR and ClS, switching signals Int, coloration changing signals Chw1 to Chw3, and signals Chw0.

Three sets of input signals Sig1 to Sig3 are respectively entered to the D-type flip-flop circuits FR1 to FR3 in synchronization with the rising edges of the clock signals ClR and ClS. The input signals Sig1 to Sig3 are related to the three segment electrodes S1 to S3, respectively. when they are in a high level, this indicates that the respective ones of the segment electrodes S1 to S3 are colored. Output signals respectively developed from the D-type flip-flop circuits FR1 to FR3 are introduced to the following D-type flip-flop circuits FS1 to FS3 with a delay time of one clock interval in the clock signals ClR and ClS.

The D-type circuits FS1 to FS3 develop the coloration changing signals Chw1 to Chw3 which are brought to a level, say, high level only when the segment electrodes S1 to S3 should be turned from erasing conditions to coloration conditions. The signals Chw0 are obtained by logically adding the three coloration changing signals Chw1 to Chw3. The switching signals Int are inverted to produce the aforementioned erase timing signals E, the switching signals Int acting to switch coloration and erase timings. The above-stated write timing signals W are obtained from the signals Chw0 and the switching signals Int with a NAND calculation. Then if the coloration changing signals Chw1 to Chw3 are in a high level, $W=\overline{Int}$.

The writing controlling signals S1W to S3W and the erasure controlling signals S1E to S3E are all logically formed by the switching signals Int, the signals Chw0, the coloration changing signals Chw1 to Chw3, and output signals from the D-type flip-flop circuits FR1 to FR3.

Figure 5:
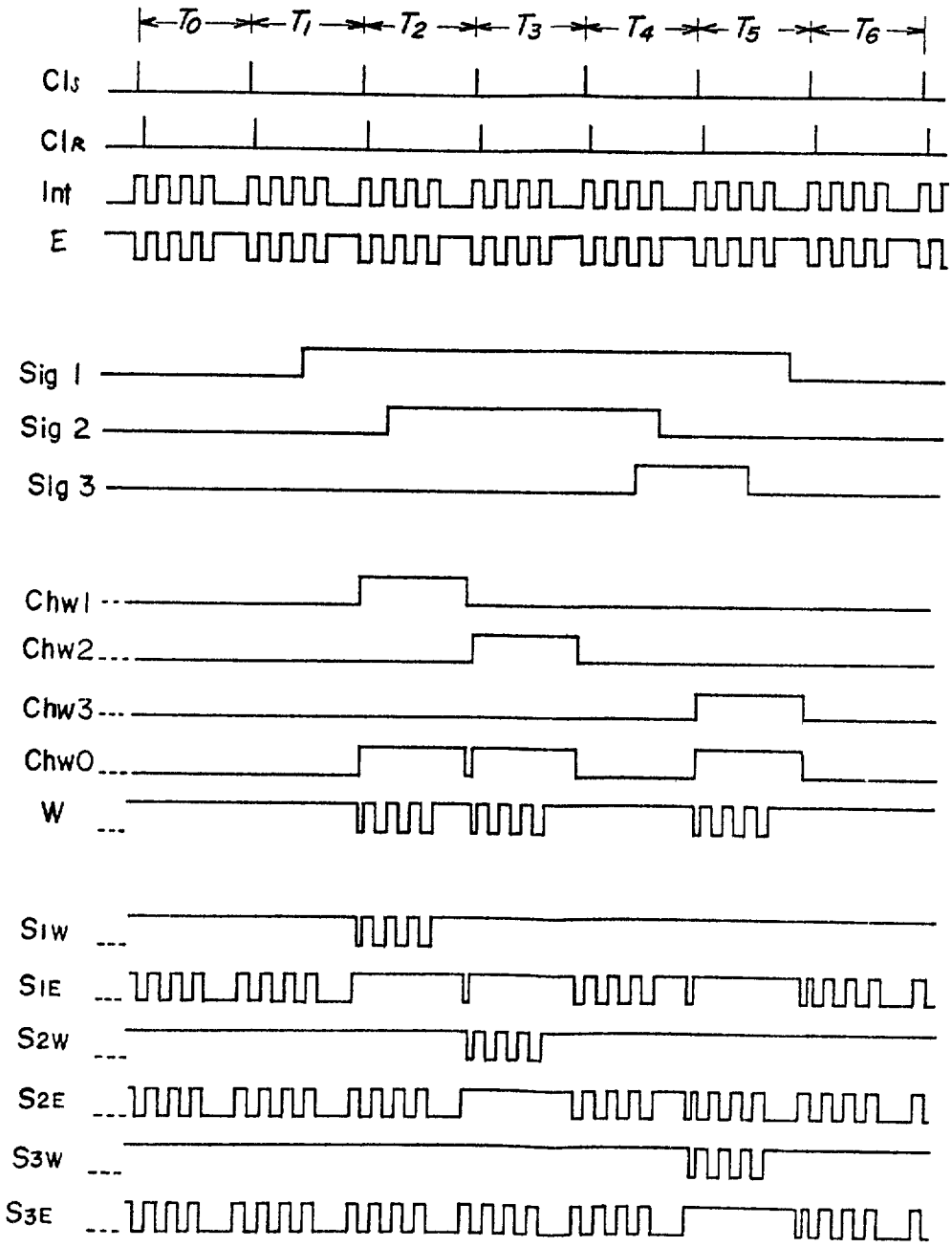
FIG. 5 is a time chart of the control signals developed from the signal generator shown in FIG. 4.

FIG. 5 illustrates a time chart of the above-mentioned various signals. The minimum frequencies of the clock signals ClR and ClS, the switching signals Int, and the erasure timing signals E are determined according to response times of the electrochromic display applied, ordinary in the range of about 100 m seconds to about several tens seconds. To clearly illustrate a relationship between the various signals in FIG. 5, the width of the pulses of the switching signals Int is shown to be wider than the actual pulses and a number of pulses are omitted. There are labeled a plurality of frame numbers T0 to T6.

With reference to FIGS. 3 to 5, in frames T0 and T1, the three D-type of flip-flop circuits FR1 to FR3 have the input signals Sig1 to Sig3 in the low level. Accordingly, the switching signals Int develop at terminals at which the erasure controlling signals S1E to S3E should generates. Since the erasure timing signals E are the signals inverted from the switching signals Int, the MOS transistor TrE becomes conductive when the erasure timing signals E are in the high level. The counter electrode C is grounded so that the plus erasure voltage $V_{DE}$ is applied to the three segment electrodes S1 to S3 to thereby intermittently erase them.

In the next frame T2, the output signals developed from Q terminal of the D-type flip-flop circuit FR1 are positioned in the high level. Simultaneously, the coloration changing signals Chw1 are in the high level to direct that the segment electrodes S1 should be colored. The segment electrode S1 is colored as follows.

When the coloration changing signals Chw1 change to the high level, the signals Chw0 are then in the high level so that inverted signals $\overline{Int}$ from the switching signals Int generate at the terminal where the writing timing signals W are to be developed. The inverted signals $\overline{Int}$ are also developed as the coloration controlling signals S1W. Accordingly, the segment electrode S1 is colored when the inverted signals $\overline{Int}$ are brought to the high level because the plus writing voltage $V_{DW}$ is applied to the counter electrode C, the plus constant voltage VX is entered to the gate of the MOS transistor TW1 so that the MOS transistor TW1 pulls a constant current from the counter electrode C to the segment electrode S1. When the inverted signals $\overline{Int}$ are changed to the high level, the gate of the MOS transistor TW1 is grounded so that further coloration to the segment electrode S1 stops. At this coloration time for the segment electrode S1, pulses determined by the plug erasure voltage VDE are being applied, in timesharing manner, to the remaining segment electrodes S2 and S3 which are to be erased, with the control of the erasure controlling signals S2E and S3E.

In the following frame T3, the coloration changing signals Chw2 are in the high level to color the segment electrode S2 as described in connection with the segment electrode S1. While the coloration of the segment electrode S2 is being performed, no signals for changing the colored condition of the segment electrode S1 are applied to the same but erasing pulses obtained by the erasure voltage VDE are applied to the segment electrode S3 to be erased in timesharing manner with the help of the erasure controlling signals S3E.

In the following frame T4, it is assumed that all the segment electrodes S1 to S3 maintain their coloration or erasure conditions. The signals Chw0 is kept in the low level. At the timing when the colored electrodes S1 and S2 should have the erasing pulses determined by the erasure voltage VDE, the counter electrode C is placed in an open condition. Accordingly, at this timing the segment electrodes S1 and S2 are shorted to each other since the MOS transistors TE1 and TE2 act like a bidirectional switch. If there is any difference between the coloration depth of the segment electrodes S1 and S2, a current flows therebetween due to the difference in amounts of the counter electromotive force provided in the segment electrodes S1 and S2. Therefore, the difference in the coloration of them is eliminated spontaneously.

On the other hand, the erasing pulses by the erasure voltage VDE are applied to the segment electrode S3 to be erased when the counter electrode C is grounded.

In the next frame T5, the segment electrode S2 is turned from the colored to the erased conditions and the segment electrode S3 is changed from the erased to the colored conditions. In frame T5, coloration pulses of the constant current and erasing pulses of the constant voltage are both applied in timesharing manner as mentioned above. It appears that the erasure of the segment electrode S2 and the coloration of the segment electrode S3 are simultaneously performed.

In the last frame T6, the segment electrodes S1 and S3 are erased. Commonly to the above-stated all frames, the erasing pulses are all entered to the segment electrode S2 which is kept erased.

Operations in the whole frames are explained above. Since the timesharing control is performed for coloring and erasing purposes in FIG. 5, the sum of coloration periods of time in one frame is equal to the sum of the time when the inverted signals Int are placed in the high level. On the other hand, the sum of erasure periods of time is that of the timing when the switching signals $\overline{Int}$ are in the low level and then the erase timing signals E are in the high level.

According to a specific form of the present invention as shown in FIG. 5, the coloration periods of time are shorter than the erasure periods of time and, in addition, the coloration periods of time do not exist in rear portions of a piece of the frames. The reason of this is that since the coloration depth of the segment electrode depends on an amount of the current per unit area entered, if an amount of the current in the constant current driving methods is increased even in the rearest portion of a piece of the frames, the coloration depth is then increasing even at the rearest portion of the frame.

In other words, a response time in the coloration of the segment electrode is equivalent to the duration of the frame. When the period of the frame is considerably short, say, less than or equal to about 200 msec, it appears that there should be no problem since the response time is instantaneous. However, concerning a long duration of the frame, say, when time information should be displayed where minimum display unit is in the form of minute, the duration of the frame is about 60 sec. The display controlled with such a long response time is not suitable in appearance.

Therefore, it is not desirous in such a long duration frame that coloration operations of the segment electrodes be carried out over the whole duration of the frame. Instead, it is preferable that the coloration operations be completed within about one second or so from the former edge of a frame so as to appear that the response time is short. Erasing time needed for changing from coloration conditions to erasure conditions is not more than about several hundreds m second, but in order to complete the erasure operations, the erasure time be longer.

The reason forming timesharing control is that it looks like coloration and erasure operations are being performed simultaneously using a power supply source and, in addition, that the short-circuiting between the color segment electrodes and the application of the erasing pulses to the erased segment electrode are being carried out in parallel. The power voltage VB, the erasure voltage VDE, and the writing voltage VDW can be all produced with the same power supply source.

Figure 6:
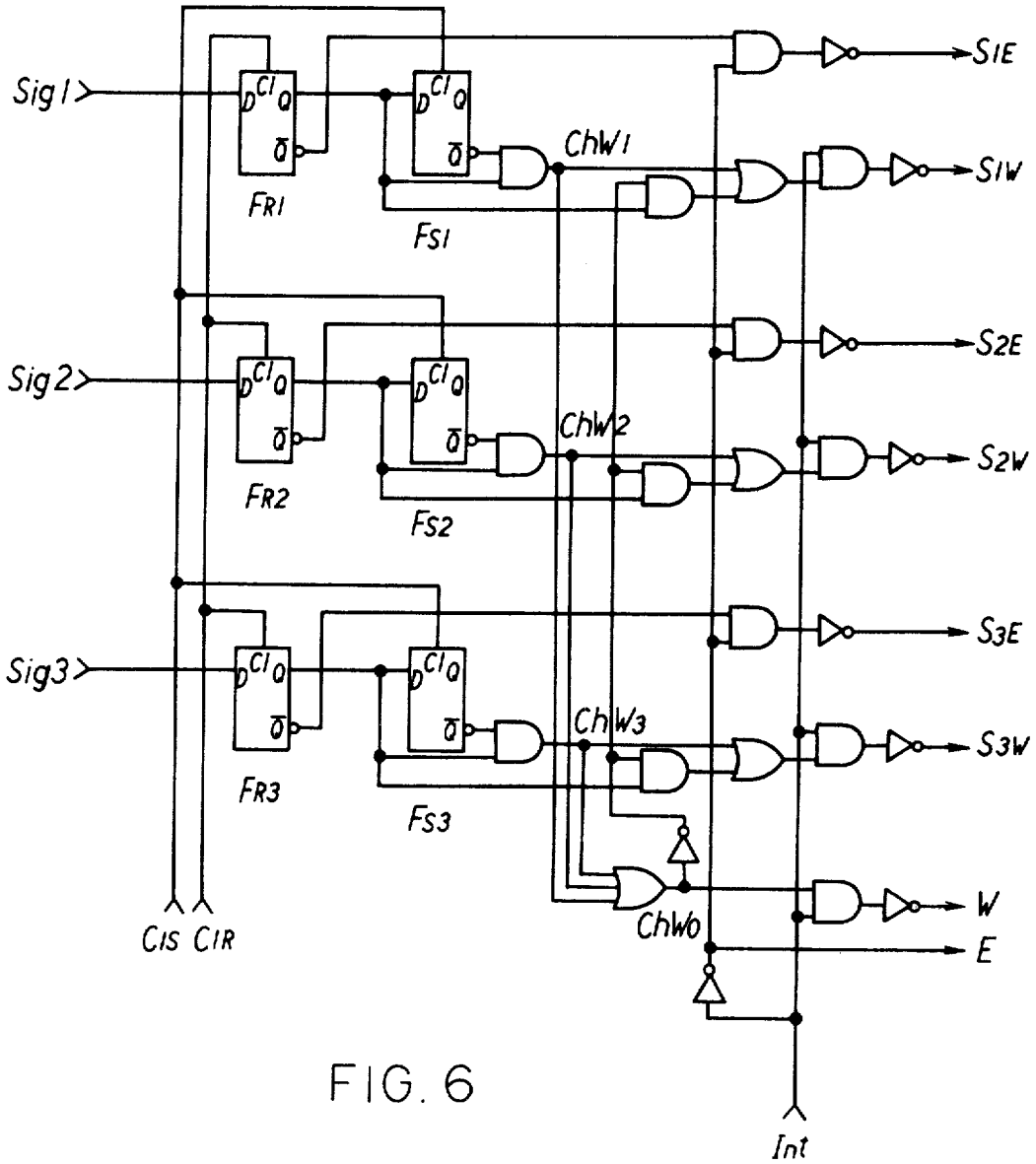
FIG. 6 is a circuit configuration of another specific signal generator for generating a plurality of signals used to control the driving circuit shown in FIG. 3.
Figure 6:
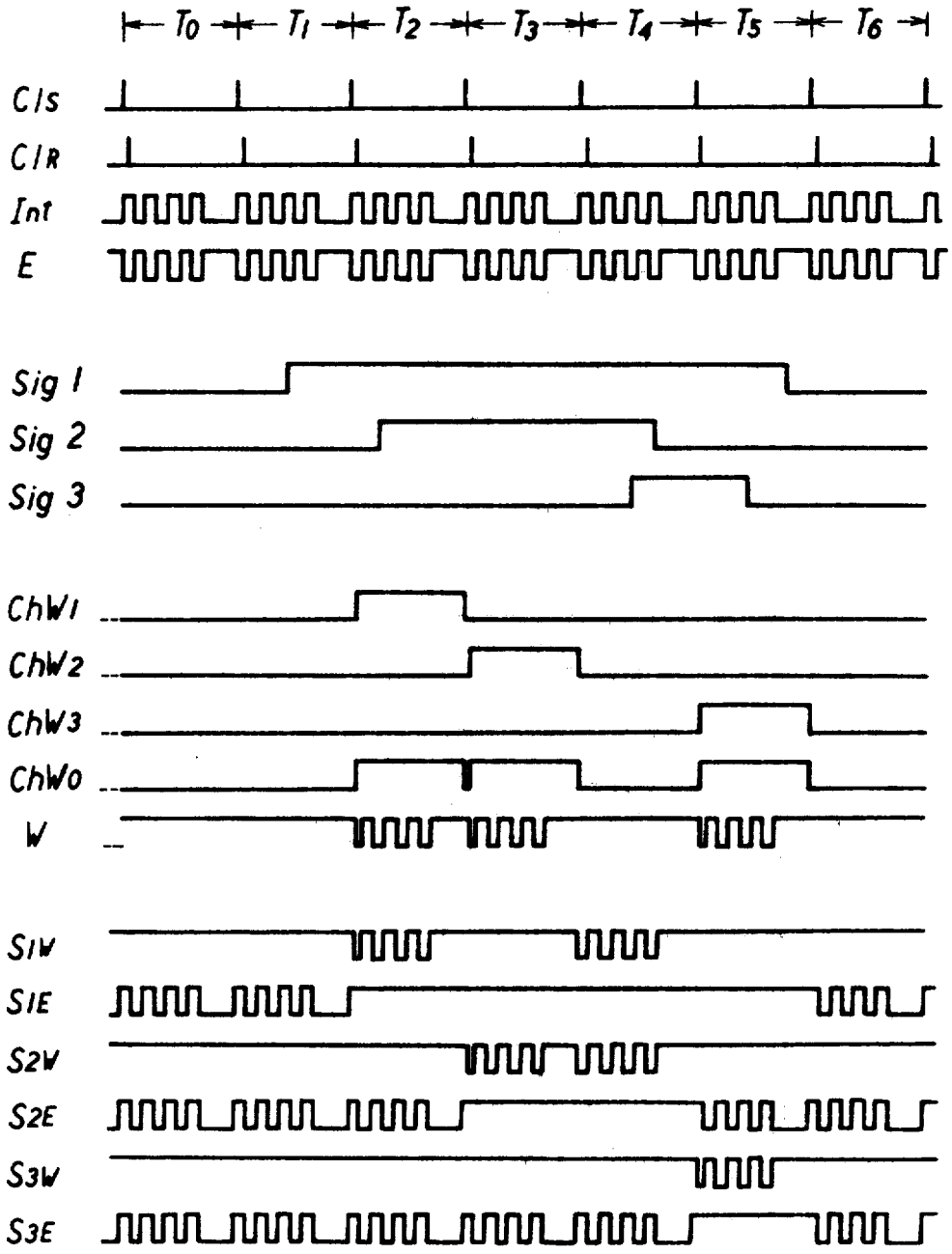

FIG. 6 shows another specific form of the signal generator related to the same shown in FIG. 4. The signal generator indicated in FIG. 6 develops control signals used for permitting the N-channel MOS transistors TW1 to TW3 for constant current during methods to short circuit the colored segment electrodes in order to uniform the coloration depth therein. Like elements corresponding to those in FIG. 4 are indicated by like numerals.

FIG. 6(A) shows a time chart of the control signals generated from the signal generator of FIG. 6.

Figure 7:
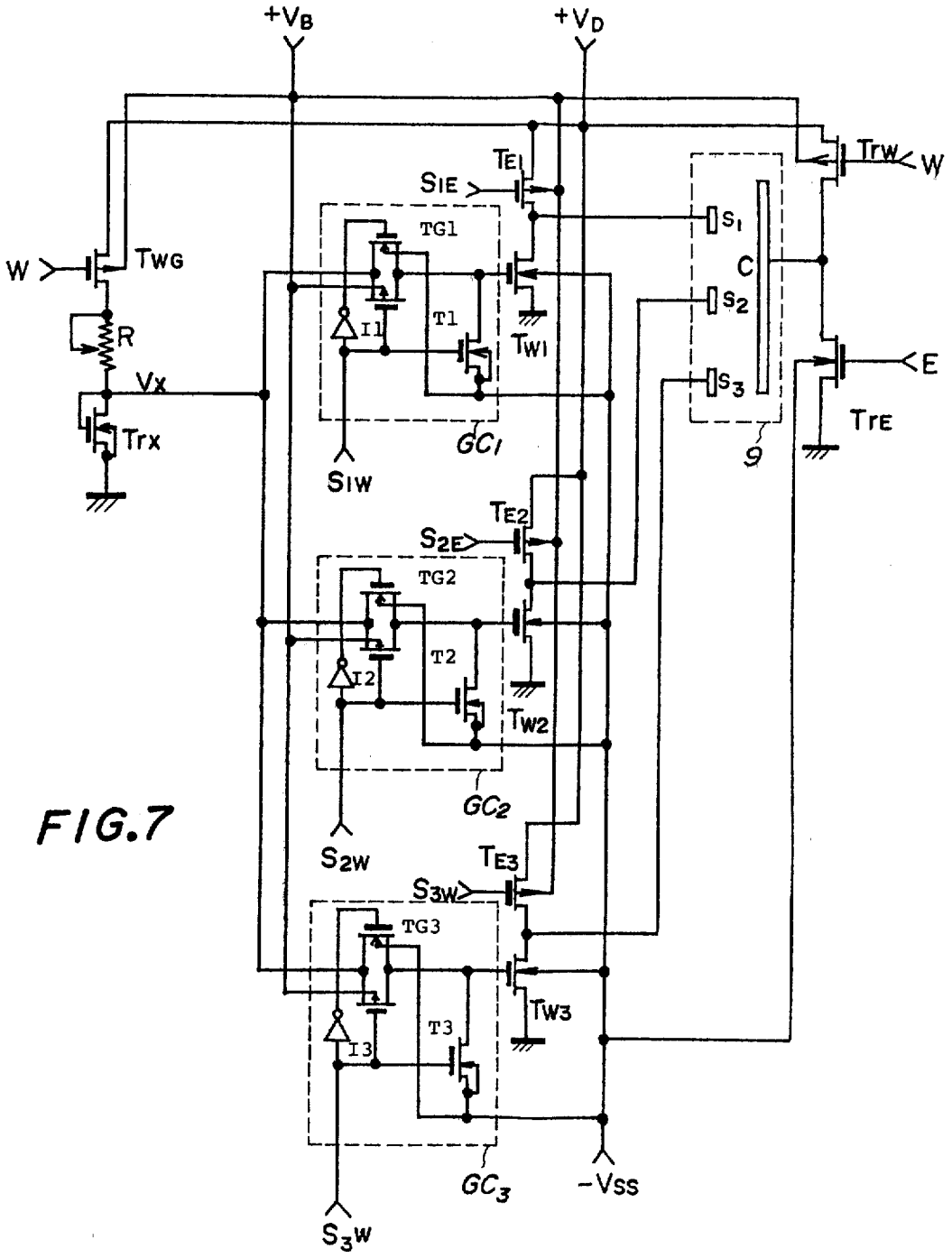
FIG. 7 is a circuit configuration of another driving circuit related to that shown in FIG. 3.

FIG. 7 illustrates another specific form of the driving circuit related to FIG. 3. The driving circuit shown in FIG. 7 is provided for separating substrate supplied voltage for coloration and erasure controlling transistors from source applied voltage thereof. It is required to eliminate the influence with the counter electromotive force provided in the electrochromic display cell that the substrate supplied voltage is isolated from the source applied voltage as mentioned below.

As is well known, the electrochromic display has a memory function, where the colored condition of the display electrodes can be maintained while remaining open under the condition that the display electrodes are colored with an application of plus voltage to the counter electrode and with the application of minus voltage to the display electrodes. Depending on material used for the counter electrode, an amount of plus voltage is produced between the counter and the display electrodes.

When $WO_3$ is also used for the counter electrode as for the display electrode, a value of the plus voltage is about several ones over ten [v]. A reverse voltage is applied to the display electrode to erase it, where a minus voltage corresponding to the plus voltage is about several ones over ten [v] although the absolute value is smaller in the erased condition than in the colored conditions.

In the driving circuit shown in FIG. 3, it is now assumed that the segment electrode S3 is kept colored and the erasing pulses are introduced to the segment electrode S2. For this purpose, the erasure timing signals E are brought to the high level so that the counter electrode C is grounded to permit the segment electrode S3 to be open and the segment electrode S2 to have the erasing voltage VDE applied. To apply the erasing voltage VDE to the segment electrode S2, it is necessary for the erasure controlling signals S2E to be brought to the low level as commonly as the writing controlling signals S2W. However, even if the erasure controlling signals S3E are in the high level and the writing controlling signals S3W are taken to the low level for the purpose of making the segment electrode S3 open, an amount of a minus voltage is applied to the segment electrode S3 due to the counter electromotive force produced under the condition that the counter electrode C is grounded and the segment electrode S3 is colored.

If the amount of the minus voltage is large enough to make a parasitic diode provided between the drain and the substrate of the transistor TW3 conductive, a closed circuit comprising the segment electrode S3, the transistor TW3, the earth, the counter electrode C, and the segment electrode S3 is accomplished so that, though the segment electrode S3 is colored, a current flows to erase the segment electrode e S3 somewhat, thereby reducing the coloration depth of the segment electrode S3.

The above description is related to the transistor TW3 operated to only color the related segment electrode S3. An undesired current path can be similarly formed owing to the parasitic diode existing in another transistor operable for causing the erasing mode under other circumstances to thereby damage remarkably the display properties of the electrochromic display.

A purpose of the driving circuit illustrated in FIG. 7 is to prevent the parasitic diode from becoming conductive. To this end, with reference to FIG. 7, a substrate applied voltage is isolated from a different electrode, say, a source or a drain electrode in a transistor through which a current passes to cause coloration and erasing operations of the segment electrode.

In particular, according to an example of the present invention, the substrates of the P-channel MOS transistors TE1 to TE3 and TrW are connected to a plus voltage +VB whereas the substrates of the N-channel MOS transistors TW1 to TW3 and TrE are connected to a minus voltage −VSS. An amount of the plus voltage VB is preferably selected so that it is higher than anyone of voltages applied to all the transistors TW1 to TW3, TE1 to TE3, TrW, and TrE.

An amount of the minus voltage −VSS is preferably selected that it is lower than anyone of voltages applied to the substrates. A single power voltage +VD is related to the erasing voltage VDE and the writing voltage VDW.

The various signals applied to the driving circuit shown in FIG. 7 have the same time chart as illustrated in FIG. 5 or FIG. 6(A). Although the nonconductivity of the parasitic diode is somewhat assured by the separation of the substrate applied voltage from the source or the drain applied voltage, the selection of the values of the plus voltage VB and the minus voltage −VSS further ascertains the nonconductivity of the parasitic diode.

Figure 8:
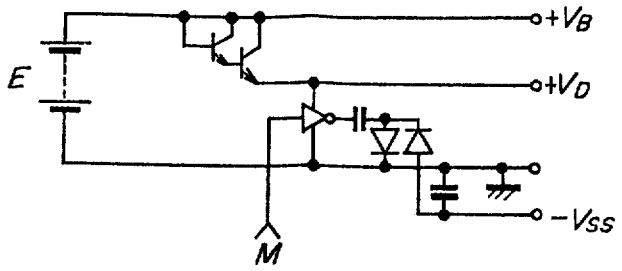
FIGS. 8(A) and 8(B) are circuit configurations of a power supply circuit for the driving circuit shown in FIG. 7.
FIG. 8(C) is an explanation for a kind of signals applied to the power supply circuit shown in FIGS. 8(A) and 8(B).
Figure 8:
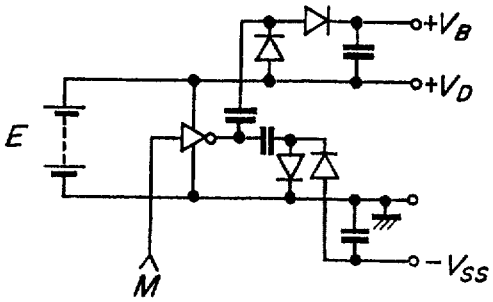
Figure 8:
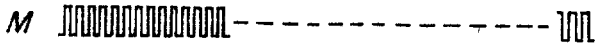

FIGS. 8(A) and 8(B) shows a power supply circuit for developing the above-stated power voltages VB, VD, and −VSS applied to the driving circuit indicated in FIG. 7. The power supply circuit shown in FIGS. 8(A) and 8(B) is energized by a power source E and rectangular signals M, the rectangular signals M being shown in FIG. 8(C). The frequency of the rectangular signals M is about several hundreds Hz.

With reference to FIG. 8(A), the plus voltage VB is generated with the power source E and the power voltage VD is developed with a pair of bipolar transistors which are coupled in base-emitter connection to drop the value of the power voltage VD. The minus voltage −VSS is produced with a voltage doubler circuit of minus polarity. Although the base-emitter connection is provided at two couples in FIG. 8(A), the number of the base-emitter connection is freely selected due to required voltage.

Referring to FIG. 8(B), the power voltage VD is generated with the power source and the power voltage VB and the minus voltage −VSS are both formed with two voltages doubler circuits of plus and minus polarity.

A plurality of numbers of the power sources are provided in FIGS. 8(A) and 8(B). But only one power source can be utilized where there can be provided a lithium battery generating a high voltage in FIG. 8(A) and a silver oxide battery in FIG. 8(B) which is stable though it generates only a small amount of output voltage.

While only certain embodiments of the present invention have been described, it will be apparent to those skilled in the art that various changes and modifications may be made therein without departing from the spirit and scope of the invention as claimed.

What is claimed is:

1. Driving circuit means adapted to color and bleach selected segment electrode contained within an electrochromic display means to provide a change from one display configuration to another within a predetermined time frame, comprising:

write means responsive to a write signal for applying a constant current to a first one or more segment electrodes to color same;

erase means responsive to an erase signal for applying a constant voltage to a second one or more segment electrodes to erase same;

time sharing means responsive to a said predetermined time frame for constraining said write means and said erase means to color and erase said first and second one or more electrodes in time shared sequence within said predetermined time frame; and uniformizing means included in either said write means or said erase means, responsive to said time-sharing means for short circuiting said first one or more segment electrodes following the coloration thereof with those previously colored electrodes common to said one and another display configurations between those periods in said predetermined time frame when said write means and erase means are actuated.

2. A driving circuit in accordance with claim 1, wherein said write means comprises a first plurality of bi-directional switching elements connected respectively between said segment electrodes and ground.

3. A driving circuit in accordance with claim 2, wherein said erase means comprises a second plurality of bi-directional switching elements connected respectively between said first plurality said segment electrodes and a constant voltage power supply on the other end.

4. A driving circuit in accordance with claim 3, wherein said colored segment electrodes are short-circuited together through said second plurality of bi-directional switching elements in the absence of energization of said write means and said erase means.

5. A driving circuit for coloring a plurality of segment electrodes contained within an electrochromic display, comprising:

means for applying a constant current to a desired number of said segment electrodes for coloring the desired segment electrodes, said means for applying including means connected to each of said segment electrodes for short-circuiting the desired segment electrodes together to unify the depth of coloration of said segment electrodes, said means for short-circuiting including a first plurality of MOS transistors connected respectively to each of said desired segment electrodes, said first plurality of transistors having a substrate and another terminal, said MOS transistors including a parasitic diode between said substrate and said another terminal, said substrate of each of said first plurality of MOS transistors being connected to a first voltage, the other terminal being connected to a second voltage, said first voltage being isolated and separate from said second voltage;

whereby said parasitic diode within said MOS transistor is prevented from becoming conductive thereby tending to maintain a uniform depth of coloration on the desired segment electrodes.

6. A driving circuit in accordance with claim 5, wherein the absolute value of said first voltage exceeds the absolute value of said second voltage.

7. A driving circuit in accordance with claim 5, wherein said means for applying further includes a second plurality of MOS transistors, each having one terminal connected respectively to each of said desired segment electrodes and to said first plurality of MOS transistors and each having a second terminal connected to ground, each of said second plurality of MOS transistors having a substrate, the substrate of each of said second plurality of MOS transistors being connected to a third voltage, said third voltage being separate and isolated from said first voltage and from said second voltage.

8. A driving circuit in accordance with claim 7, wherein the absolute value of said third voltage is lower than the absolute value of said second voltage.

9. A driving circuit adapted to color and bleach segment electrodes contained within an electrochromic display to provide a display configuration change over a finite interval, comprising:

write means responsive to a write signal to color a first plurality of segement electrodes consistent with said display change;

erase means responsive to an erase signal to erase a second plurality of said segment electrodes consistent with said display change; and short circuiting means to short circuit the said first plurality of said segment electrodes following the coloration thereof between periods in said finite interval when said write means and erase means are actuated to uniformize the color of said first plurality of segment electrodes;

said short circuiting means comprises a circuit means comprising an integral part of either said write means or said erase means.

10. A driving circuit in accordance with claim 9, wherein said write means applies a constant current and said erase means applies a constant voltage to the respective said pluralities of segment electrodes.

11. A driving circuit in accordance with claim 10, wherein said driving circuit further includes time sharing means for constraining said write and erase and short circuiting means to be actuated in a time sharing manner over said finite interval.

* * * * *